US006941871B2

(12) United States Patent
Mauldin

(10) Patent No.: US 6,941,871 B2
(45) Date of Patent: Sep. 13, 2005

(54) FACETED EXPANSION RELIEF PERFORATING DEVICE

(76) Inventor: Sidney Wayne Mauldin, P.O. Box 1794, Pampa, TX (US) 79065

( * ) Notice: Subject to any disclaimer, the term of this patent is extended or adjusted under 35 U.S.C. 154(b) by 0 days.

(21) Appl. No.: 10/701,792

(22) Filed: Nov. 5, 2003

(65) Prior Publication Data

US 2005/0115441 A1 Jun. 2, 2005

(51) Int. Cl.[7] ..... F42B 1/02

(52) U.S. Cl. ..... 102/323; 102/310; 102/320; 89/1.15

(58) Field of Search ..... 89/1.15; 102/310, 102/312, 320, 323

(56) References Cited

U.S. PATENT DOCUMENTS 2,873,676 A * 2/1959 Caldwell ..... 175/4.6
3,951,218 A * 4/1976 Sjogren ..... 175/4.6
4,191,265 A * 3/1980 Bosse-Platiere ..... 175/4.56
4,193,460 A * 3/1980 Gilbert ..... 175/4.6
4,773,299 A * 9/1988 Oestreich et al. ..... 89/1.15
4,919,050 A 4/1990 Dobrinski
6,014,933 A * 1/2000 Umphries et al. ..... 102/312
6,460,463 B1 * 10/2002 Parrott et al. ..... 102/312

FOREIGN PATENT DOCUMENTS

CA 0538543 * 3/1957 ..... 89/1.15
SU 0125529 * 1/1960 ..... 102/310

* cited by examiner

*Primary Examiner*—Stephen M. Johnson
(74) *Attorney, Agent, or Firm*—Brian Powley

(57) ABSTRACT

The present invention is an improvement in the design of a perforating gun to perforate the casing in oil and gas wells. Perforating guns have a cylindrical body member with explosive charges at specified intervals designed to shoot outwardly through the body member, the well casing, cement sheath, and into the rock formation. Continuous faceted cuts in the vessel covering the greater part of the circumference, at the level of the charge, serve to reduce the outward distortion of the body member beyond the original diameter of the body member. Reducing the distortion serves to insure that the perforating gun can be removed from the well after the explosive charges have fired.

13 Claims, 3 Drawing Sheets

FACETED EXPANSION RELIEF PERFORATING DEVICE

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

The invention relates generally to an improvement in the design of an oil and gas well perforating device. The improvement applies to a type of perforating device that is typically lowered into the well through the casing or tubing in the well to a position where the explosive charges are detonated at the desired depth. The improvement is a method of decreasing the distortion of the device after detonation to ensure that it can be pulled back out of the well.

After an oil or gas well is drilled, steel casing is lowered into the well and cemented to the adjoining rock formations. Typically, perforations are needed to allow the oil or gas from the desired rock formation to be able to flow into the casing and then out of the well. The perforations are made by lowering, on a wireline or tubing, the perforating gun containing explosive charges to the desired depth and detonating the charges. There are several different types of perforating guns.

One type of perforating gun is referred to as a casing gun. A casing gun is a hollow steel carrier that is lowered into the casing of the well with the perforations made through screwed in ports. This type of perforating gun is of sufficient size that there is not usually significant distortion caused to the carrier from the explosive charge and the hollow steel carrier can be reused a number of times. There is not any issue as to the removal of this type of perforating gun after the detonation as there is not any distortion and the clearances between the casing and the perforating gun are more than sufficient.

A second type of perforating gun is an expendable casing gun. This is similar to the previously discussed casing gun with the addition of larger charges that will cause significant distortion to the hollow steel carrier. The distortion is sufficient to make the hollow steel carrier useable only one time and therefore expendable. The larger charges are sometimes needed when greater penetration is required such as when some of the rock formation has washed away and there is a greater amount of cement to penetrate. The distortion can be sufficient as to cause retrieval problems.

A third type of perforating gun is a tubing conveyed perforating gun. The tubing is a retrievable string of pipe inside of the casing that is permanently cemented in place. This is another type of casing gun except the carrier is made a part of the tubing string rather than being run on the wireline. Depending on the size of the charge, distortion of the carrier can be sufficient to make the perforating gun expendable. The distortion can be sufficient as to cause retrieval problems.

All of the previously discussed perforating guns are made to be lowered into the casing. There are also perforating guns made to be lowered into the tubing. These through tubing perforating guns are designed to be utilized while leaving the tubing inside the well and casing. In order for the perforating guns to be lowered inside of the tubing requires a smaller diameter perforating gun. The through tubing perforating guns are lowered through the tubing to a desired depth, below the bottom of the tubing, at the desired rock formation.

A fourth type of perforating gun is a through tubing strip gun run on wireline. This type of perforating gun includes a strip carrier on which capsule shaped charges may be mounted. The capsule shaped charges are sealed to protect the charges from the well environment. At detonation the strip gun is basically blown apart and the debris drops to the bottom of the well below the perforations. Any intact portion of the strip gun is then retrieved through the tubing.

A fifth type of perforating gun is the retrievable through tubing gun which is like the casing gun in that it uses a sealed carrier to hold the charges but is a smaller diameter to fit inside the tubing. The smaller diameter is not as capable of absorbing the explosive charge and the outer diameter of the hollow carrier is distorted. The distortion occurs at the level of the charge around most of the circumference of the sealed hollow carrier. This distortion can be enough to prevent the perforating gun from being retrieved back into the tubing after being fired.

All of the perforating guns discussed utilize a sealed carrier with the exception of the strip gun. The sealed carriers have recessed areas at the location of the charges. The recessed area is to reduce the amount of energy the charge loses in exiting the perforating gun.

The swelling and distortion of the perforating gun, caused by the explosive charge, is an important consideration when using the expendable casing gun, the tubing conveyed perforating gun and the retrievable tubing gun. There has been a patented well perforating device of Dobrinski, U.S. Pat. No. 4,919,050, that was designed for the purpose of reducing the excessive deformation. That patent uses a band of removed steel cut all the way around the hollow carrier, or body member, such that the outward distortion does not exceed the outer diameter of the perforating gun. The present invention offers many advantages over the Dobrinski patent. The present invention removes much less steel as the faceted cuts absorb energy, and the cuts are only made where they are necessary. This structurally stronger design of the present invention allows for achieving the primary objective of limiting the outward distortion to the outer diameter of the body member while at the same time achieving all other necessary aspects of a perforating gun, and providing additional benefits such as being made out of standard steel.

There continues to be a need to be able to minimize the outward distortion of some perforating guns. Excessive distortion can result costly remedial measures and can even run the risk of making the well junked and abandoned. The method of reducing the distortion must also maintain the performance of the perforating charges and maintain sufficient integrity of the carrier housing.

SUMMARY OF THE INVENTION

The present invention is a well perforating device and method of manufacture to make a plurality of connected faceted cuts in the outer surface of the body member at the level of the perforating charge covering the greater part of the circumference. These faceted cuts serve to control the swelling and outer deformation of the perforating gun, after detonation, in a manner such that less steel is removed resulting in a stronger structural integrity. The stronger structural integrity helps to achieve all of the other aspects necessary for a perforating gun and allow this design to use standard steel.

Other embodiments and features will become apparent from the following description, drawings and claims.

DETAILED DESCRIPTION

In the following description, details of the present invention are given to provide an understanding of the present invention. However, those skilled in the art will know that the present invention may be practiced without these details and that numerous variations or modifications from the described embodiments are possible.

Figure 2:
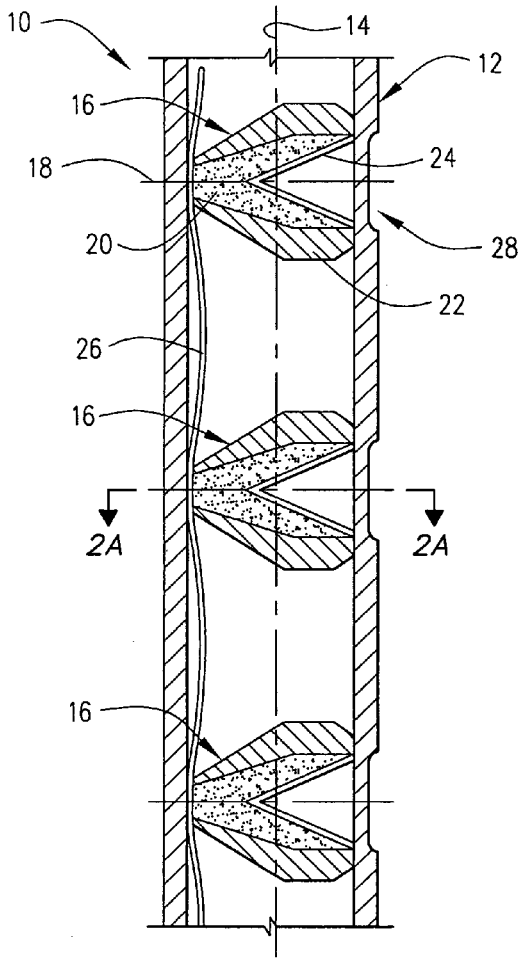
FIG. 2 PRIOR ART
FIG. 2 is a partial, cross sectional view of a typical prior art well perforating device along the longitudinal axis of the device.

FIG. 2 is a side cross sectional view of a typical prior art perforating device 10 used to perforate the casing, cement and rock formation in an oil and gas well to allow the reservoir fluids to flow into the well. The perforating device 10 comprises a cylindrical body member 12, which is sealed to protect the plurality of charges 16 from the fluids in the wellbore and from the hydrostatic pressures of those fluids. The body member 12 has a smaller outer diameter than the inner diameter of the casing or tubing in order for the body member 12 to be slidably received within the longitudinal inner diameter of the casing or tubing. The body member 12 outer diameters range from two to seven inches and are most typically in the two to four inch range.

Within the body member 12 is a plurality of charges 16. The perforating charges 16 are spaced at intervals along the longitudinal axis of the body member 12 depending on the intervals of the rock formation desired to be perforated. The spacing of the charges also depends on the perforating charge density with typical density being four and six shots per foot. The axis of each charge 16 is perpendicular to the axis of the body member 12. The perforating charges 16 are positioned in circular patterns around the interior of the hollow steel carrier 12. These circular patterns are referred to as the phasing of the perforating charges 16 with typical phasing being 0, 60, 90, 120 and 180 degree phasing.

Each perforating charge 16 is comprised of explosive material 20 shaped in the form of a cone. The explosive material 20 is contained between the charge case 22 and charge liner 24. The charge case 22 acts as a containment vessel designed to hold the force of the detonating explosive long enough for the charge liner 24 to collapse and form a perforating jet (not shown) along the axis of charge 18. This perforating jet perforates the body member 12, the steel casing of the well, the cement sheath surrounding the casing, and the rock formation.

There is a recessed hole penetration area 28 cut in the outer wall of the body member 12 where the perforating charge 16 is positioned. The recessed hole penetration area 28 is aligned with the perforating charge 16 such that the perforating jet exits through the recessed hole penetration area 28 to lessen the force needed to exit the body member 12. Decreasing the force needed to exit the boy member 12 increases the remaining force available to penetrate the casing, cement and rock formation. The recessed hole penetration area 28 can be accomplished in different ways and the method depicted of a scallop is a common method. Another common method for the re-useable casing and tubing conveyed guns is a screwed in port plug that can be discarded and replaced. Regardless of the type of recess, the size of the explosive charge relative to the body member 12 may be small enough to allow multiple uses of the body member 12 or it may be large enough to cause distortion significant enough to make the body member 12 expendable and only useable one time. The types of perforating guns that have significant enough distortion as to be expendable are casing guns with larger charges for greater penetration, tubing conveyed guns with larger charges and through tubing guns. The distortion can not only make the body member 12 expendable, but the distortion can be sufficient to make retrieval through the internal diameter of the casing or tubing a problem.

Figure 2A:
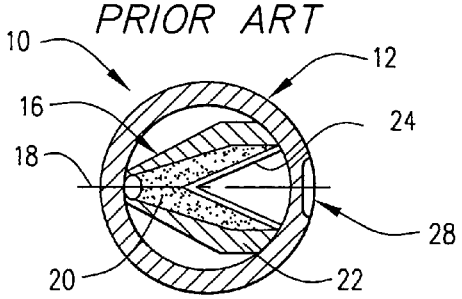
FIG. 2A PRIOR ART
FIG. 2A is a partial, cross sectional view of the prior art perforating device of FIG. 2 along line 2A—2A.

FIG. 2 is a cross-sectional longitudinal view of the typical prior art 10 prior to detonation. In this drawing all the charges are in the same direction which is zero degree phasing. This drawing illustrates the perforating charges all connected to the detonating cord 26 that is attached to a wireline that goes up the well, through the wellhead and to the perforating truck, where the firing of the perforating guns is controlled. The drawing also illustrates the recessed hole penetration area 28 cut in the body member 12 perpendicular to the axis of the perforating charges 18. FIG. 2A is a top view of a cross section through the axis of a perforating charge 18, of FIG. 2, and again illustrates the recessed hole penetration area 28 in the body member 12 opposite the perforating charge 16.

Figure 3:
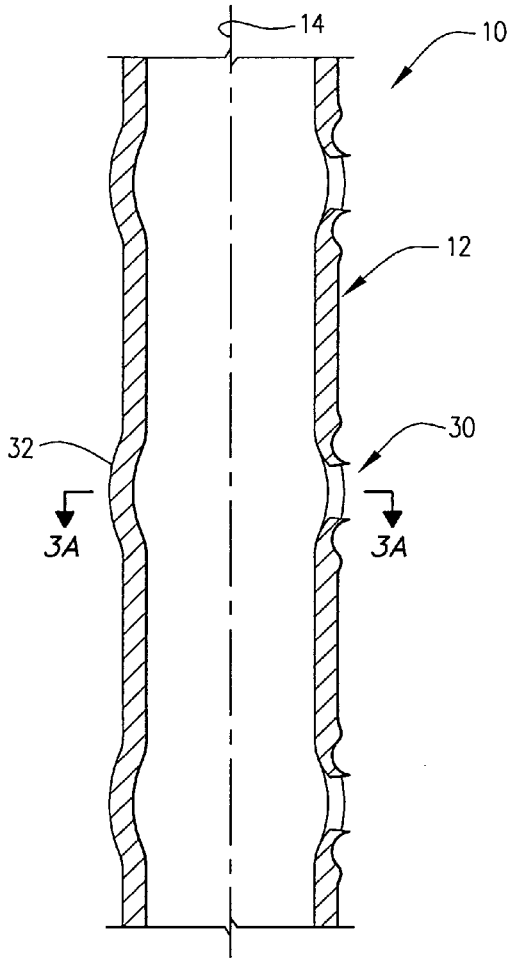
FIG. 3 PRIOR ART
FIG. 3 is a partial, cross sectional view of the prior art perforating device of FIG. 2 after detonation, of the perforating charge, and taken along the longitudinal axis of the device.
Figure 3A:
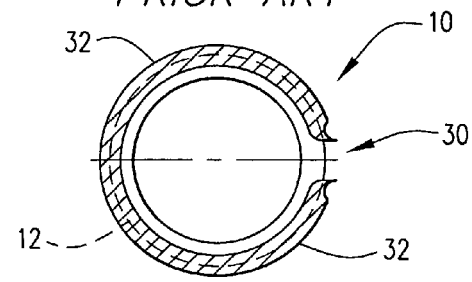
FIG. 3A PRIOR ART
FIG. 3A is a partial, cross sectional view of the prior art perforating device of FIG. 3 along line 3A—3A.

FIG. 3 is a cross-sectional longitudinal view of the typical prior art 10, of FIG. 2 after detonation. The perforating charges 16 and detonation cord 26 have been blown apart (not shown), as they drop as debris to he bottom of the body member 12, and are no longer visible in the cross-sectional view. The drawing illustrates the swelled out area 32 of the body member 12 at the level that the perforating charges 16 were at. The swelled out area 32 of the outer diameter of the body member 12 encompasses most of the circumference of the body member 12 with the exception of an area directly to either side of the recessed hole penetration area 28. FIG. 3A is a top view of a cross section through the axis of a charge 18, of FIG. 3, and again illustrates the swelled out area 32 of the body member 12 with the exception of an area directly to either side the recessed hole penetration area 28 for the perforating jet to exit. The original outer diameter of the body member 12 is represented by the dashed line and the swelled out area 32 outer diameter is represented by the outer solid line.

The present invention utilizes a plurality of connected faceted cuts 46 around most of the exterior of the body member 42 at the level of each perforating charge 16. The size, radius, number and depth of the facets depend on the size of the body member 42. These faceted cuts 46 cover the portion of the body member 42 that absorbs the energy from the detonation of the perforating charge 16 and is distorted outward. The faceted cuts 46 serve to absorb the energy in a controlled manner such that the distortion that is created by the perforating charge 16 does not extend appreciably beyond the outer diameter of the original outer diameter of the body member 42. When the outer diameter of the body member 42 in the area of the perforating charge 16 does not extend appreciably beyond the outer diameter of the rest of the body member 42, there is a reduced risk of getting stuck in the casing or tubing and not being able to retrieve the perforating gun.

Figure 1:
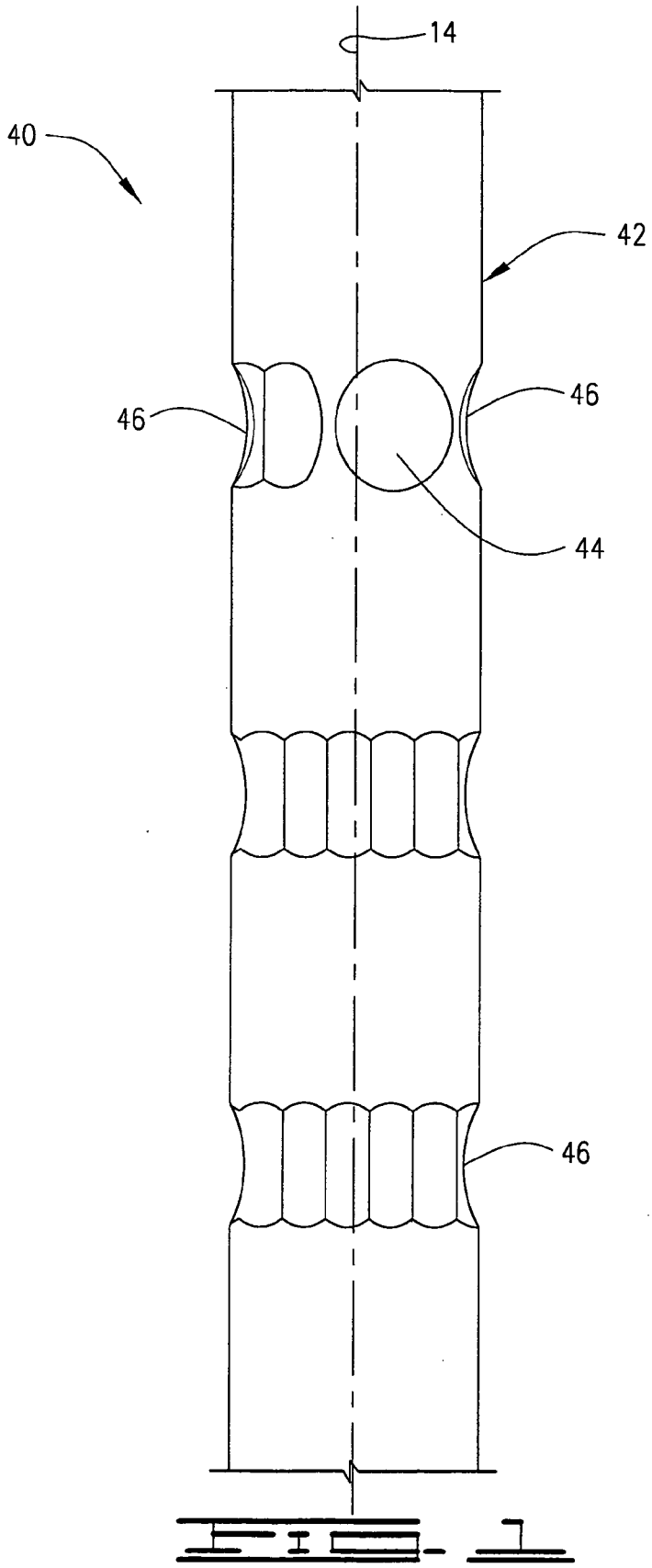
FIG. 1 is a partial side view of the present invention perforating device body member.

FIG. 1 is a side view of the present invention 40 perforating device body member 42. The larger individual scallop is the recessed hole penetration area 44 at the location of the perforating charge 16. The perforating charges 16 in this illustration have ninety degree phasing and this is the reason that only one of the recessed hole penetration areas 44 is visible in the drawing. At the same level as the recessed hole penetration area 28 for the perforating charge 16 is a plurality of connected faceted cuts 46 surrounding most of the circumference of the body member 14. This plurality of connected faceted cuts 46 is the present invention.

Figure 4:
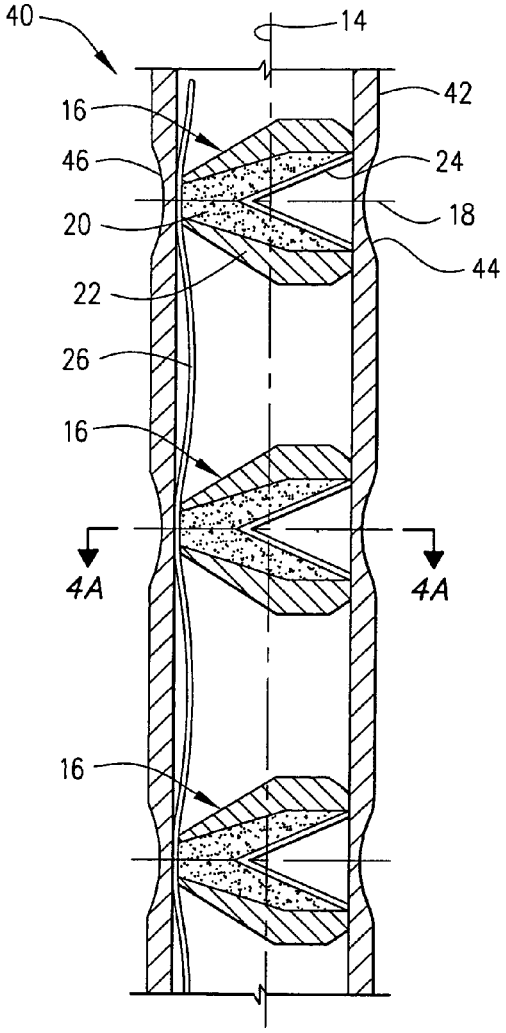
FIG. 4 is a partial, cross sectional view of the present invention well perforating device taken along the longitudinal axis of the perforating device.
Figure 4A:
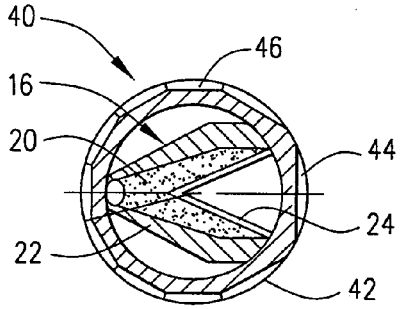
FIG. 4A is a partial, cross sectional view of the present invention perforating device of FIG. 4 along line 4A—4A.

FIG. 4 is a cross-sectional longitudinal view of the present invention 40 prior to detonation. The drawing illustrates the perforating charges 16, with zero degree phasing, connected by the detonation cord 26. The drawing illustrates the recessed hole penetration area 44 in the body member 42 opposite the perforating charge 16 and the slightly smaller recess in the body member 42 that is part of the plurality of connected facets 46 that surround most of the circumference of the body member 42. FIG. 4A is a top view of a cross section of the present invention through the axis of a perforating charge 18, of FIG. 4, again illustrating the recessed hole penetration area 44 opposite the perforating charge 16 and the smaller recess of the plurality of connected faceted cuts 46 surrounding most of the rest of the circumference of the body member 42 with the exception of the area on either side of the recessed hole penetration area 44.

Figure 5:
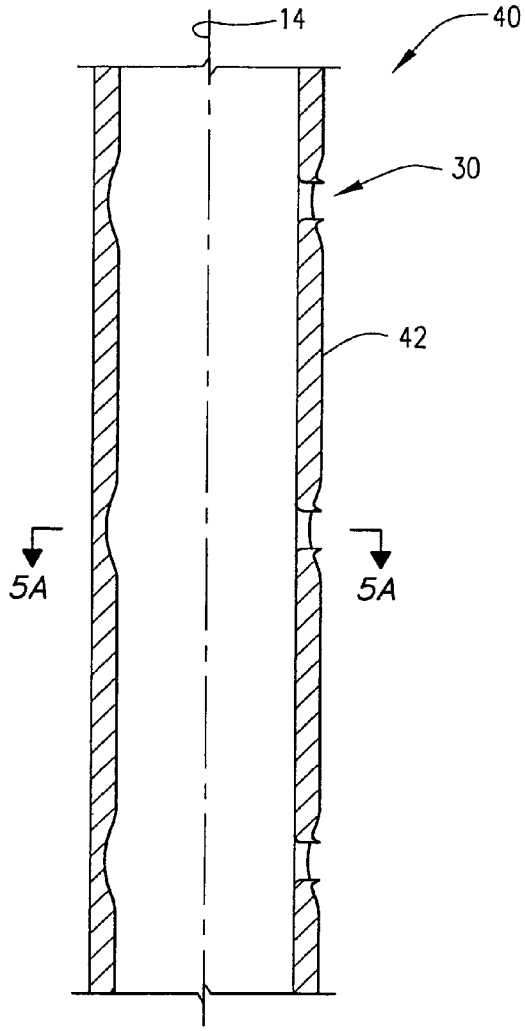
FIG. 5 is a partial, cross sectional view of the present invention well perforating device taken along the longitudinal axis of the perforating device after detonation of the perforating charge.
Figure 5A:
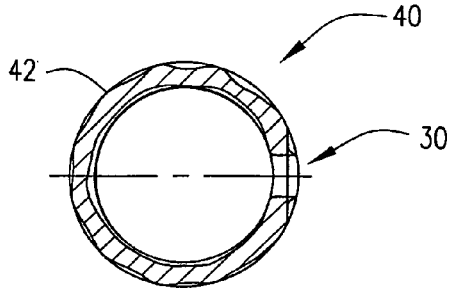
FIG. 5A is a partial, cross sectional view of the present invention perforating device of FIG. 5 along line 5A—5A.

FIG. 5 is a cross-sectional longitudinal view of the present invention 40 after detonation. The perforating charges 16 and detonation cord 26 have been blown apart (not shown), dropping to the bottom of the body member 42 and are no longer in view in the cross-sectional view. The drawing illustrates how the plurality of connected faceted cuts 44 have absorbed the forces of the detonation and have limited the swelling of the body member 42, at the level of a detonated perforating charge 16, to basically the original outer diameter of the body member 42. FIG. 5A is a top view of a cross-section through the axis of a detonated perforating charge 18, of FIG. 5, that again illustrates how the area of the plurality of connected faceted cuts 44 expands outward to approximately the original outer diameter of the body member 42.

There has been a patented well perforating device of Dobrinski, U.S. Pat. No. 4,919,050, which was designed for the purpose of reducing the excessive deformation. There is no drawing of the Dobrinski prior art. The Dobrinski design is a band cut all the way around the body member with a flat portion in the middle of the band and tapered sections, on either side of the flat section, that increase up to the full outer diameter of the body member.

The primary object of the Dobrinski patent was to remove enough steel in a band cut all the way around the body member at the level of the perforating charge such that the swelling caused from the detonation would not exceed the original outer diameter of the body member. The other objects were to have sufficient strength so as be retrieved, constrict the effects of the detonation, to retain the explosive debris and to be operated under the harsh environment encountered in deep wells. All of these other objects are necessary for any perforating gun. These other objects were only at issue as the method of obtaining the primary object of removing the band of steel around the body member weakened the perforating device's ability to accomplish these other necessary objects.

The present invention 40 is an improvement over the Dobrinski patent. The primary object of the present invention 40 is also to reduce the outward distortion caused from the detonation of the perforating charge. All of the other objects of the Dobrinski patent are also objects of the present invention 40. The present invention 40 is an improvement over the Dobrinski patent as it accomplishes all of the objects of the Dobrinski patent better. The biggest problem with the Dobrinski patent and removing enough steel cut in a band around the body member is the loss in structural strength. The present invention 40 does not remove steel all the way around the body member 42. The present invention 40 removes much less steel and focuses on the area that receives the forces from the detonation. The area where steel is removed, in the present invention 40, is not cut as wide. Less steel needs to be removed, in the present invention 40, as the faceted cuts 46 add to the strength. The flat portion of the each faceted cut 46 provides a place for the detonation forces to dissipate while the arch and adjoining edges of each faceted cut 46 provide structural strength. The adjoining edges of the faceted cuts 46 makes the explosive charge distribute the forces more uniformly. By limiting the steel removal to the area receiving the forces, the smaller faceted cuts 46 achieve the primary object of lessening the swelling beyond the original outer diameter of the body member 42 while at the same time maintaining much greater structural integrity. Increasing the structural integrity serves to better achieve all of the other objects. Increasing the structural integrity increases the likelihood of being able to retrieve the perforating gun, the ability to constrict the effects of the detonation, the ability to retain the explosive debris, and the ability to withstand the harsh environment of deep wells.

In addition to the present invention 40 being an improvement in all of the objects of the Dobrinski patent, there are also some other specific advantages. The wide band cut in the Dobrinski patent limited the shot density to 4 shots per foot as with 6 shots per foot the bands would be immediately adjacent to one another and would weaken the hollow steel carrier as to make it fail. The Dobrinski patent states that the full outer diameter intervening sections are needed to prevent collapse at high hydrostatic pressures and to prevent the propagation of cracks. The design of the Dobrinski requires high alloy steel with more nickel in order to maintain structural integrity. The high alloy steel is more expensive and must be purchased in mill runs with long lead times. The design of the present invention 40 does not remove as much steel and can be made with industry standard heat treated steel material. The tooling of the present invention 40 is more involved and therefore more expensive, in that regard, than the Dobrinski design but the less expensive steel more than makes up that difference making the present invention 40 less expensive to make. The band cut in the Dobrinski design also encompasses the recessed perforation area for the perforating jet, whereas the present invention 40 does not use the recessed hole penetration area 44 as part of the design allowing greater flexibility in the design of the recessed hole penetration area 44 for the perforating jet such as to improve perforating depth performance. Any swelling resulting from the present invention 40 would be in high points on the edges of the connected faceted cuts 46 which would be much less likely to cause sticking problems than any swelling on the Dobrinski design which would be on a larger surface area and more likely for friction to cause it to get stuck when trying to retrieve the perforating gun. The plurality of connected faceted cuts 44, on the present invention 40, allow for adjustments to be made for any particular variation experienced with different charges, whereas the Dobrinski design is cut uniformly all the was around the body member. The connected faceted cuts 46 can be adjusted for size and shape including the arch being convex or concave. Even with the greatly reduced amount of steel removed, the present invention needs to be detonated in liquid to cushion the forces exerted on the body member 42. The present invention 40 will work with normal hydrostatic pressure. There are numerous advantages of the present invention 40 over the prior art 10 and particularly over the Dobrinski patent.

The present invention 40 provides significant improvements upon the typical prior art 10 in the field of perforating guns for oil and gas wells. The present invention 40 also provides significant improvements over the Dobrinski design, which is the only known attempt to overcome the problems addressed by the present invention 40. The better design of the present invention 40 is based on the plurality of connected faceted cuts 46 over a portion of the circumference to absorb the forces of detonation rather than cutting a much wider band all the way around the body member, as in the Dobrinkski design. The design of the present invention 40 provides for much stronger structural strength to better accomplish all of the objects of the Dobrinski design, including the primary objection to reduce outward swelling of the outer diameter of the body member. The stronger structural strength of the present invention 40 also better accomplishes all of the remaining objects of the Dobrinski design of having sufficient dimensional stability to permit retrieval from the well after detonation, to constrict the forces of the detonation, to contain the debris from explosive charges, and to withstand the harsh environment of deep wells. The design of the present invention 40 also provides additional benefits of allowing higher shot density, the use of standard steel, greater flexibility in the design of the recess for the perforating jet, less chance of sticking from swelling with high points rather than larger surface areas with more friction, and the flexibility for adjustments in the recessed hole penetration areas 44 and the connected faceted cuts 46 for particular variances of different charges.

EXAMPLE

The present invention 40 was tested by constructing a perforating device as described in the Detailed Description of the Invention and detonating it under the following conditions. The body member 42 was constructed with industry standard heat treated steel with an outer diameter of 2.030 inches, a yield strength of 145,000 to 160,000 psi and an average impact strength of 51.6 ft-lbs (Charpy-V full size). The body member 42 was hydrostatically tested to 22,500 psi with no failure. A variety of industry standard 7 gram perforating charges 16 of different manufacturers were used with a shot density of 6 shots per foot. When detonated at 2500 psi, the maximum swelling was 2.055 inches. When detonated covered by water at atmospheric pressure, the maximum swelling was 2.086 inches. These figures compare with typical normal swelling of 2.125 for 4 shots per foot and 2.170 for 6 shots per foot.

The design of the present invention 40 is much better suited, over the prior art, to accomplish the objectives stated as well as those inherent therein. While the present preferred embodiment of the present invention has been described, numerous changes could be made by those skilled in the art which are encompassed within the spirit of the invention as described.

What is claimed is:

1. A well perforating device comprising a tubular body member having a plurality of inwardly shaped hole penetration areas of reduced thickness formed on the outer surface thereof, and a plurality of perforating charges positioned within said body member, each of said perforating charges containing a hollow cone shaped explosive charge aligned with one of said hole penetration areas so that upon detonation of the hollow cone shaped charge said body member is penetrated through said aligned hole penetration areas, an improvement comprising:

a plurality of inwardly shaped connected faceted areas formed on the outer surface of said body member so as to extend around a portion of said body member at the level of said hole penetration areas and excluding said hole penetration areas, such that upon detonation of said hollow cone shaped charges of said perforating charges said inwardly shaped connected faceted areas are expanded to substantially correspond to the outside diameter of said body member.

2. The perforating device of claim 1 wherein an area corresponding to the outside diameter of said body member exists between said hole penetration areas and said plurality of inwardly shaped connected faceted areas.

3. The perforating device of claim 1 wherein said plurality of inwardly shaped hole penetration areas of reduced thickness formed on the outer surface can be up to six per lineal foot of said body member.

4. The perforating device of claim 1 wherein said hole penetration areas are excluded from said plurality of inwardly shaped connected facets, such that the shape of said hole penetration areas can be changed.

5. The perforating device of claim 1 wherein said body member can be made from standard heat treated steel.

6. The perforating device of claim 1 wherein the shape of said plurality of inwardly shaped connected faceted areas is convex.

7. The perforating device of claim 1 wherein the shape of said plurality of inwardly shaped connected faceted areas is concave.

8. A well perforating device comprising a tubular body member having at least one hole penetration area of reduced thickness formed in an outer surface thereof, and a perforating charge positioned within said body member, said perforating charge containing a hollow cone shaped explosive charge aligned with said hole penetration area so that upon detonation of said hollow cone shaped charge said body member is penetrated through said aligned hole penetration area, an improvement comprising:

a. an energy absorption means for controllably absorbing the energy of said explosive charge so that excessive deformation of the body member is prevented, said energy absorption means extending about said body member but not encompassing the hole penetration area.

9. The perforating device of claim 8 wherein said tubular body member is characterized as having said outer surface, and wherein said energy absorption means comprises a plurality of inwardly shaped connected faceted areas formed on said outer surface of said body member so as to extend around a portion of said body member at the level of said hole penetration area and excluding said hole penetration area.

10. The perforating device of claim 9 wherein said hole penetration area are excluded from said plurality of inwardly shaped connected faceted areas, such that the shape of said hole penetration area can be changed.

11. The perforating device of claim 9 wherein the shape of said plurality of inwardly shaped connected faceted areas is convex.

12. The perforating device of claim 9 wherein the shape of said plurality of inwardly shaped connected faceted areas is concave.

13. The perforating device of claim 8 wherein said body member can be made from standard heat treated steel.

* * * * *